United States Patent [19]

Svoboda

[11] 4,268,060

[45] May 19, 1981

[54] SKI BRAKE

[75] Inventor: Josef Svoboda, Schwechat, Austria

[73] Assignee: TMC Corporation, Baar, Switzerland

[21] Appl. No.: 6,389

[22] Filed: Jan. 25, 1979

[30] Foreign Application Priority Data

Jan. 27, 1978 [AT] Austria ..... 616/78
Feb. 16, 1978 [AT] Austria ..... 1102/78

[51] Int. Cl.[3] ..... A63C 7/10
[52] U.S. Cl. ..... 280/605
[58] Field of Search ..... 280/605, 604

[56] References Cited

U.S. PATENT DOCUMENTS

| | | | |
|---|---|---|---|
| 3,715,126 | 2/1973 | Schwarz | 280/605 |
| 3,964,760 | 6/1976 | Riedel | 280/605 |
| 4,101,145 | 7/1978 | Korger | 280/605 |
| 4,123,083 | 10/1978 | Riedel | 280/605 |

FOREIGN PATENT DOCUMENTS

| | | | |
|---|---|---|---|
| 2619007 | 11/1976 | Fed. Rep. of Germany | 280/605 |
| 2525945 | 12/1976 | Fed. Rep. of Germany | 280/605 |
| 2714447 | 1/1978 | Fed. Rep. of Germany | 280/605 |
| 2326214 | 4/1977 | France | 280/605 |

*Primary Examiner*—John J. Love

*Assistant Examiner*—Milton L. Smith

*Attorney, Agent, or Firm*—Blanchard, Flynn, Thiel, Boutell & Tanis

[57] ABSTRACT

A ski brake having at least one braking leg, which is pivotal by a force applied by a ski boot or by a sole plate to a pedal about an axle, which extends substantially at a right angle with respect to the longitudinal axis of the ski in a mounting member which is secured to the ski, between a braking position against a spring force into a retracted position. The braking leg has a braking mandrel with a bent segment therein which extends from the braking mandrel toward the longitudinal axis of the ski. The braking leg is held totally above the upper surface of the ski and within the width of the ski in the retracted position of the ski brake by the pedal which is stepped down upon by the ski boot or by the sole plate. In the braking position of the ski brake, the braking mandrel is held lying next to the ski edge and the braking leg projects below the running surface of the ski. The braking leg is pivotal about a swivel shaft which extends in longitudinal direction of the ski. The braking leg has at least one further bent segment which extends substantially parallel with respect to the longitudinal axis of the ski brake, which further bent segment is at the same time the swivel shaft for the entire braking leg.

19 Claims, 11 Drawing Figures

Fig.7
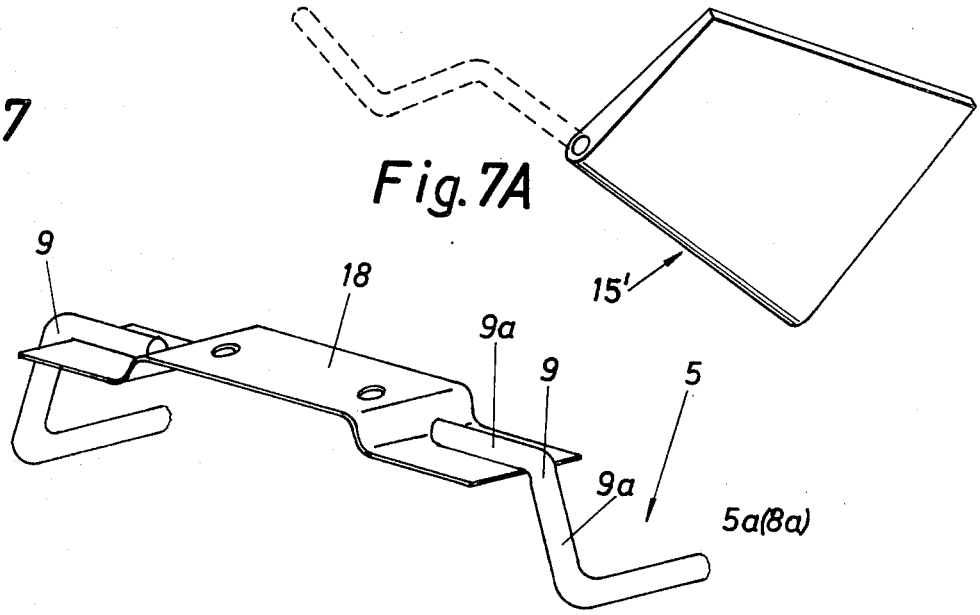
Fig.7A
Fig.8
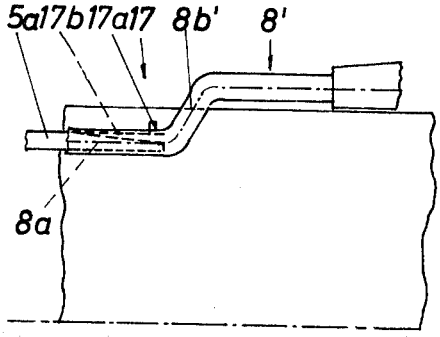
Fig.9
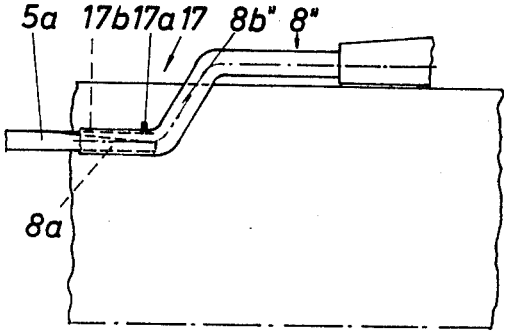
Fig.10
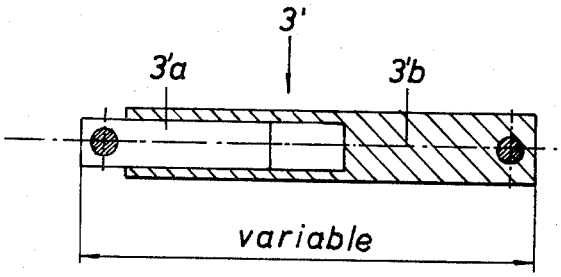

SKI BRAKE

FIELD OF THE INVENTION

The invention relates to a ski brake and, more particularly to a ski brake wherein each braking leg is pivotal about a swivel shaft which extends in longitudinal direction of the ski when in the retracted position of the ski brake.

BACKGROUND OF THE INVENTION

A ski brake of the above-mentioned type is described for example in Austrian Pat. No. 305 844 which corresponds to U.S. Pat. No. 3 715 126 (FIGS. 7 to 9). In this known construction, the pedal is constructed as a wire bar, the free ends of which are supported in a housing, wherein the housing has two laterally spaced-apart recesses on its two sides in the region of the shanks of the bar. Two extensions of the individual braking legs, which extensions are constructed as angled flaps, each are received in the recesses of the housing and are supported on swivel shafts defined by the shanks of the pedal bar which extend parallel with respect to the longitudinal axis of the ski in the retracted position. By swinging the ski brake from the retracted position into the braking position, the arms of the braking legs, which arms serve as braking mandrels are guided outwardly beyond the two lateral edges of the ski. Ski-fixed guide shoes are for this purpose associated with each braking leg adjacent the free end of each braking mandrel, which guide shoes cooperate with sloped surfaces on each braking mandrel. The entire housing is pivotally arranged about an axle which extends transversely with respect to the longitudinal axis of the ski and is supported on a ski-fixed base plate.

A base plate extends along the entire length of the braking legs. Stops are secured on the base plate, on which stops rest a pair of extensions of the braking mandrels in the retracted position of the ski brake, in order to prevent a rattling of the device during travel.

A disadvantage of this known ski brake consists in the necessity of requiring many cooperating structural parts in relationship to the structure, which causes the manufacturing process to be associated with high tolerance requirements and material expenses and the product itself is susceptible to malfunction. For example, a damage of the guide shoes can make the proper operation of the ski brake unsafe; it may even prevent operation in extreme cases. A further disadvantage consists in that during a pivoting of the ski brake from the retracted position into the braking position or vice versa, not only the braking legs and the pedal bar, but the entire housing must also be pivoted, which operation automatically results in the use of a stronger and thus also more expensive erecting spring. The housing is in the braking position of the ski brake pivoted with its entire front side at 90° to the base plate, which front side lies in the downhill skiing position perpendicularly with respect to the upper surface of the ski and with respect to the longitudinal axis of the ski and the pedal bar is positioned practically perpendicularly with respect to the upper surface of the ski. Stepping into a ski binding, which is equipped with such a ski brake, is complicated. A still further disadvantage of the known construction is that the width of the braking arms which act as braking mandrels is limited due to the construction in both directions.

The purpose of the invention is to provide a ski brake of the above-mentioned type such that only the position of the braking mandrels, which position is referred to the ski, is changed, when the ski brake is swung from the braking position into the ready position or vice versa.

The set purpose is inventively attained by the braking leg having at least one further bent segment, which is connected to a first segment and extends substantially parallel to the longitudinal axis of the ski brake, which segment is at the same time the swivel shaft for the entire braking leg.

Due to the fact that each braking leg can be rotated about the axis of a separate segment, which serves as a swivel shaft, the use of both a complicated housing and also the pivotal support of same is not required. Thus, it is possible to hold the ski brake in the braking position at an angle which is suitable for stepping in by the ski boot, which angle is in every case smaller than 90°. An angle position of approximately 60° is preferred.

A particularly preferable embodiment of the invention consists in each braking mandrel being pivotally supported in the retracted position of the ski brake above a plane which extends through the swivel shaft and lies approximately parallel with respect to the upper surface of the ski. This measure permits the braking mandrels to be supported in a position which is fully above the upper surface of the ski, without requiring additional structural parts. Furthermore this permits a practically unlimited spreading of the braking blades mounted on the braking mandrels in one direction (pointing away from the ski in the braking position of the ski brake).

It is furthermore important to the invention that the entire braking leg is constructed of one single wire which has at least two bends therein. Thus each braking leg can be manufactured simply and inexpensively. The individual braking legs can thus dimensioned exclusively corresponding to the loads which are produced through braking.

A still further development of the invention consists in the swivel shaft of the braking leg being loaded by forces applied to a dog. In a further development of this of the invention, the dog is preferably a wire extension which extends from the swivel shaft, is bent twice and is associated with the pedal, which extension is arranged preferably on the end of the swivel shaft which is remote from the first wire segment. Due to the fact that for pivoting of the braking leg from the braking position into the retracted position, an extension which is associated with the pedal of the ski brake is provided, each braking mandrel can assume the position, which is favorable and necessary for the retracted position or braking position, directly by operating the pedal.

According to a further characteristic of the invention, it is provided that each braking mandrel is supported pivotally against the force of a further spring in the retracted position of the ski brake in relationship to the associated braking leg. This measure favors the swivelling of each braking mandrel from the retracted position into the braking position, since through this the braking mandrels can be moved through spring force automatically into the braking position.

Further details, advantages and characteristics of the invention are discussed more in detail with reference to the drawings, which illustrate several exemplary embodiments.

BRIEF DESCRIPTION OF THE DRAWINGS

In the drawings:

FIGS. 1 to 6 illustrate a first exemplary embodiment of the inventive ski brake in three positions, each in a side and top view, wherein FIGS. 1 and 2 illustrate the side and top views, respectively, of the braking position, FIGS. 3 and 4 illustrate the side and top views, respectively, of the first phase of a skier stepping down onto the ski brake prior to an inward swivelling of the braking mandrel, and FIGS. 5 and 6 illustrate the side and top views, respectively, of the ski brake in the retracted position with the braking mandrel swivelled inwardly over the upper surface of the ski;

FIG. 7 is a perspective view of a detail for pivoting the braking mandrel;

FIG. 7A illustrates a fragment of a deep-snow brake blade attachment.

FIGS. 8 and 9 are each top views of one braking mandrel for skis having differing widths; and FIG. 10 is a cross-sectional view of a modification of the axle of the ski brake.

DETAILED DESCRIPTION

Figure 1:
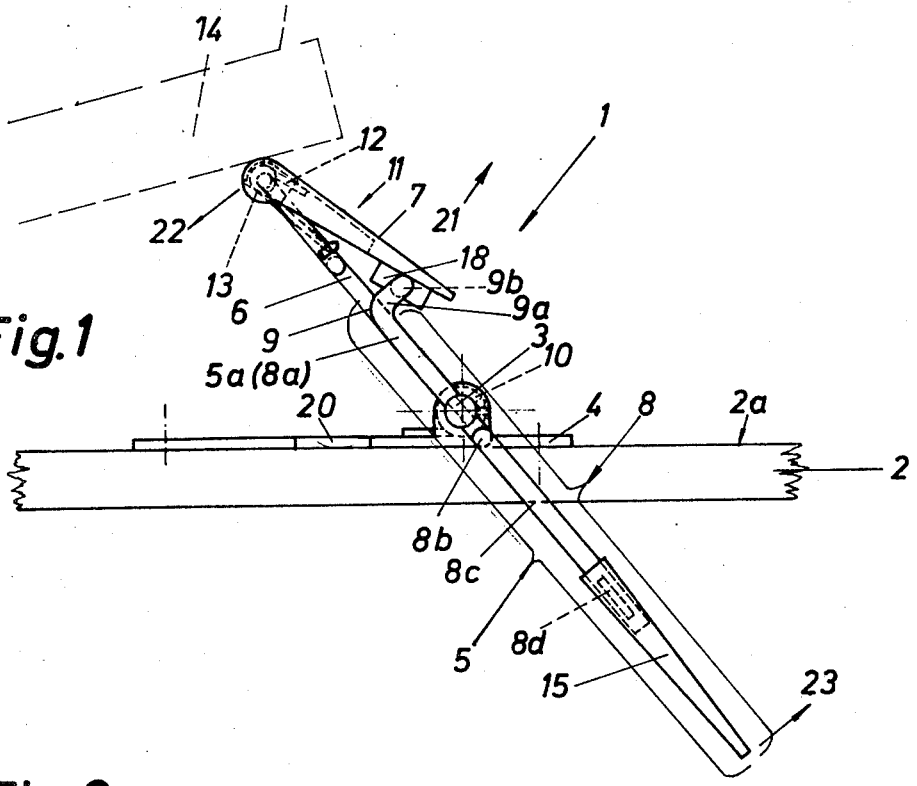
Figure 2:
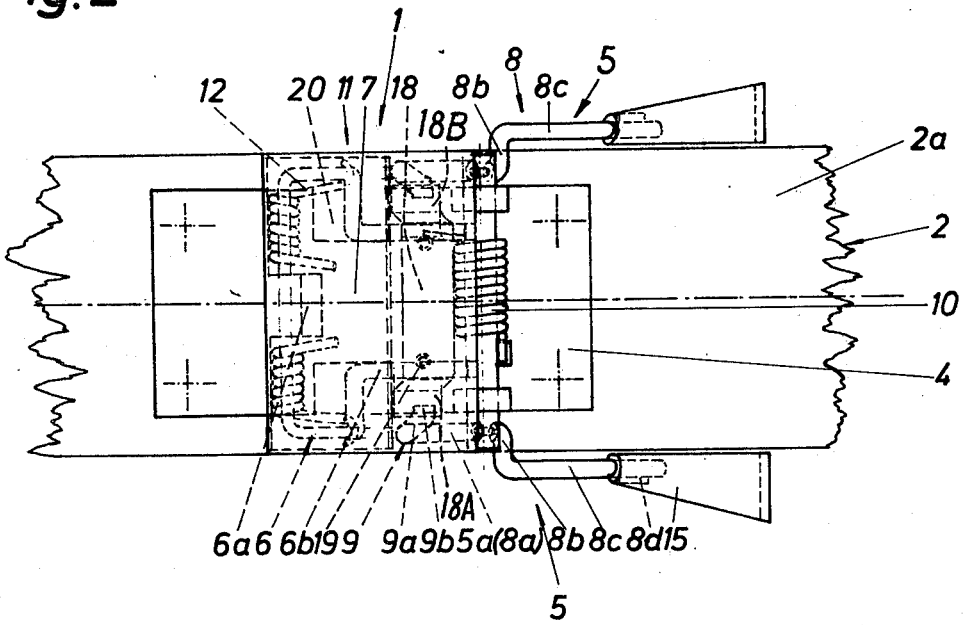

The first exemplary embodiment according to FIGS. 1 to 6 illustrates a ski brake which is identified as a whole by the reference numeral 1. The ski brake 1 is pivotally supported about the axis of an axle 3 mounted on a ski-fixed mounting member 4 which is in turn mounted on the upper surface 2*a* of a ski 2. The ski brake 1 is provided with at least one single braking leg 5 which is active in the braking position on only one side of the ski 2. The braking leg 5 includes a braking mandrel 8 having a segment 8*c* which extends parallel with respect to the longitudinal axis of the ski in the retracted position thereof and has a braking blade 15 at its free end. The braking mandrel has a first segment 8*b* which is connected to the end of the segment 8*c* which is remote from the braking blade, and a second segment 8*a* which follows the first segment 8*b*. The segment 8*b* lies in a plane which is perpendicular to the longitudinal axis of the ski. While the second segment 8*a* can be considered on the one hand as a part of the braking mandrel 8, it does form, on the other hand, a swivel shaft 5*a* for the entire braking leg 5. For this reason, two reference numerals 5*a*, 8*a* are associated with this segment in FIGS. 1 to 6. As it shall be explained with reference to the further exemplary embodiments, it is also conceivable to construct the two parts 5*a*, 8*a* separately and to then connect same to one another. The end of the braking leg 5 remote from the braking mandrel 8 has a twice bent extension 9 thereon and which is associated with a pedal in a manner which will be discussed more in detail below.

The ski brake 1 is, however, actually constructed symmetrically with respect to the longitudinal axis of the ski, so that two braking legs 5 are provided with each braking mandrel 8, which legs project in the braking position of the ski brake 1 below the running surface of the ski on both lateral sides thereof. This structure will thus stop the ski which has become disengaged from the skier, for example after a fall of the skier, or will assure the skier an easy and safe stepping into the ski binding on the ski by holding the ski fixed on a snow covered surface.

Figure 5:
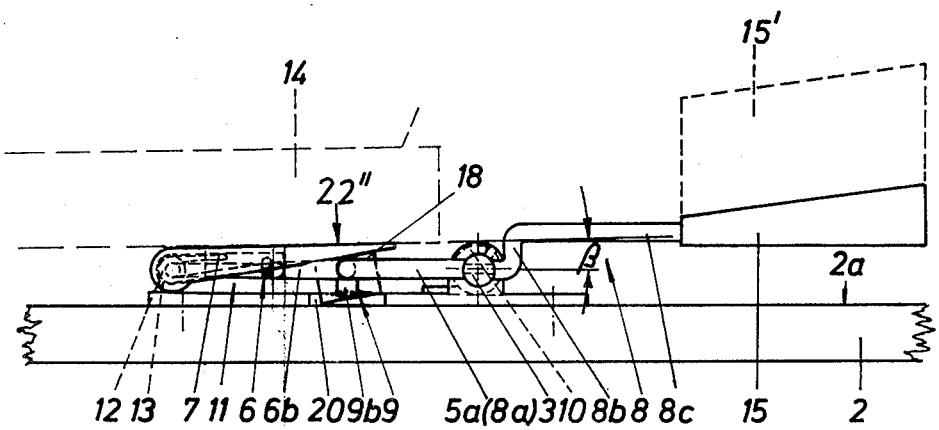
Figure 6:
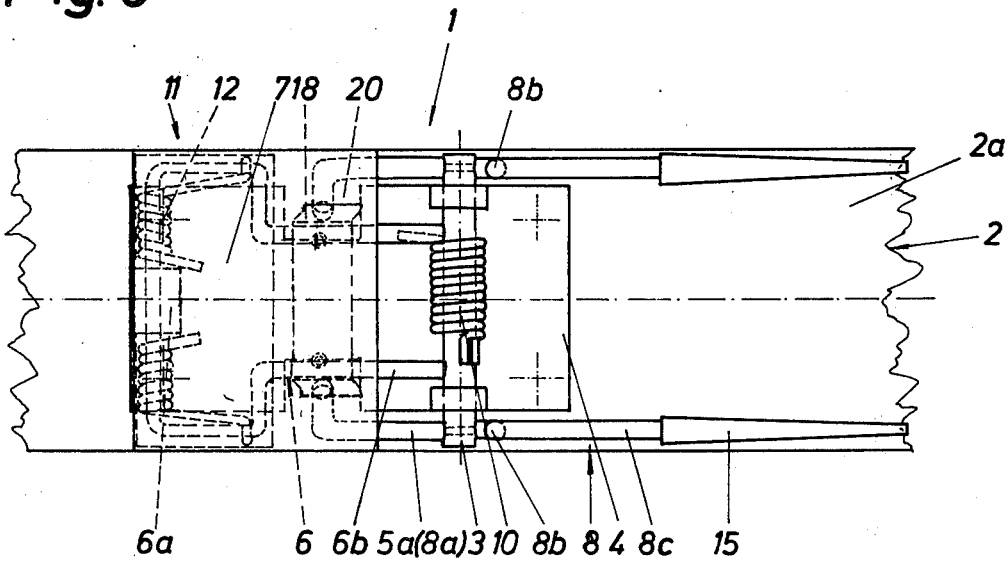

The structure of each braking leg 5 with the associated braking mandrel 8 and extension 9 can best be recognized in FIG. 5, wherein a comparison of FIGS. 1 and 5 at the same time will facilitate a recognition of the structure of the braking blade 15. Accordingly each braking mandrel 8 has starting at its end which is identical with the swivel axis 5*a* of the associated braking leg 5 a substantially rectilinearly constructed first section 8*a* which extends in longitudinal direction of the ski. A twice bent extension 9, as stated above, is provided at the end of the swivel axis 5*a* of each braking leg 5 remote from the braking mandrel 8. Each extension 9 is connected by means of a first segment 9*a* to the swivel shaft 5*a* of each braking leg 5 such that the extension 9 projects with its first segment 9*a*, in the braking position of the ski brake 1 according to FIGS. 1 and 2 and in the pivoted position of the ski brake according to FIGS. 3 and 4, from a plane through the two braking mandrels 8 away from the upper surface 2*a* of the ski and in direction toward a vertically spaced pedal 11. The extension 9 or its first segment 9*a* is thereby arranged prefereably perpendicularly with respect to the mentioned plane and thus with respect to the axis of the swivel shaft 5*a* of the braking leg 5. A second segment 9*b* of the extension 9 extends in the present exemplary embodiment parallel with respect to the first segment 8*b* of the braking mandrel 8. However, it is also conceivable to construct the second segment 9*b* of the extension 9 in relationship to its first segment 9*a* at an acute angle, wherein the plane in which the second segment 9*b* extends lies parallel with respect to the plane of each braking leg 5, which plane is determined by the swivel shaft 5*a* and by the braking mandrel 8. However, it is also conceivable to design the second segment 9*b* of the extension 9 projecting from said plane, if this appears to be advantageous for reasons of the control of the individual braking legs 5 through the pedal 11 or through a different structural part. For similar reasons it is also possible for the direction of the first segment 9*a* to differ from the perpendicular direction.

A pedal which is identified as a whole by the reference numeral 11 is secured to the axle 3 of the ski brake 1. The pedal 11 is constructed in two parts. A generally U-shaped first part is constructed as a stepping bar 6 which is secured through its two legs 6*b* to the axle 3. The bight portion 6*a* of the first part 6 is hingedly connected to a flap 7 which is biassed to the position shown in FIG. 1 at least by one spring 12. Actually, two torsion springs 12 are arranged in the present exemplary embodiment on the bight 6*a* of the stepping bar 6 and extend symmetrically with respect to the longitudinal axis of the ski. The torsion springs 12 urge the flap 7 counterclockwise away from the stepping bar 6, as this is indicated in FIG. 1 with the arrow 21. This urging of the torsion springs 12 is limited by a stop 13 provided on the flap 7. The stop 13 is supported on the underside of the stepping bar 6. Further, the stop 13 is constructed within the pedal 11, so that no additional structural part projects from the ski brake in its pressed-down position (in the retracted position). The outer surface of the flap 7 of the pedal 11 is rounded off in the area of the bight 6*a* of the stepping bar 6, which bight 6*a* serves an an axle, so that the flap 7 can easily be operated by means of the sole of a ski boot 14. The sole of the ski boot 14 (or also a sole plate) is only partially indicated in broken lines in FIGS. 1, 3 and 5. The direction of swinging of the ski brake 1 from the braking position illustrated in FIGS. 1 and 2 into the retracted position is indicated in FIG. 1 by the two arrows 22, 23. This separate identification of the swing in the area of the pedal 11 and in the area of the free ends of the braking mandrels 8 which have the braking blades 15 thereon, will facilitate a better understanding of the operation of the ski brake 1, which operation will yet be discussed. The ski brake 1 is pivoted against the force of a torsion spring 10 which encircles and acts onto the axle 3.

The free end of each extension 9 is gripped under and by a leaf spring 18 which is secured to the flap 7 for example by means of rivets 19. In the present exemplary embodiment, compare in particular FIG. 7, one single leaf spring 18 is associated with the bent free ends 9*b* of the two extensions 9. The leaf spring 18 has thereby an inverted U-shaped profile with laterally extending flanges 18A and 18B secured to the ends of each of the legs of the U-shaped profile. The free ends of the segments 9*b* of the two extensions 9 rest on the individual flanges 18A, 18B of the leaf spring 18. The braking mandrels 8 are moved into the retracted position by a swinging of the braking legs 5, which will be described more in detail hereinafter, wherein the flanged parts of the leaf spring 18 are placed under tension by the two extensions 9 of the individual braking legs 5. It must also be remarked that the mounting member 4 has recesses or notches 20 therein which are positioned symmetrically with respect to the longitudinal axis of the ski and on opposite lateral sides thereof, the depth of which recesses is dimensioned such that in the retracted position of the ski brake 1, the free ends 9*b* of the extensions 9 will be received in the recesses.

The second segment 8*b* of each braking mandrel 8 which follows the first segment 8*a* is angled at an angle of approximately 90° to the segment 8*c*, so that in the braking position of the ski brake 1 the next segment 8*c* of the braking mandrel 8 lies outside, namely outwardly beyond the side edges of the ski 2. One braking blade 15 is arranged on each segment 8*c*. Each segment 8*c* has a key 8*d* or the like received in a keyway in the braking blade in order to fix the position of the braking blade 15 with respect to the braking mandrel 8. The segment 8*c* extends substantially parallel with respect to the first segment 8*a* of the braking mandrel 8, so that also between the segments 8*b* and 8*c* there is provided a substantially right angle bend. The braking blade 15 consists generally of a plastic, which is applied to the braking mandrel 8 by means of a coating process. The arrow indicates in FIG. 3 the direction of rotation of the braking mandrel 8, wherein the angle of rotation $\alpha$ lies in the range 0° to 180°.

Figure 3:
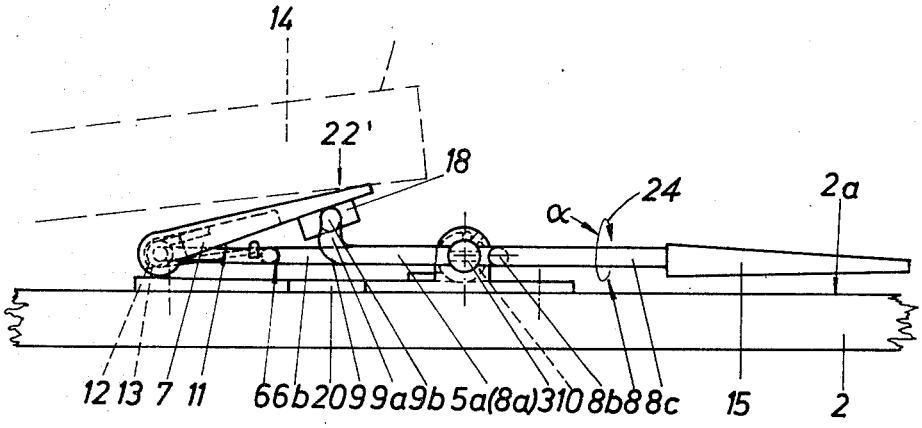
Figure 4:
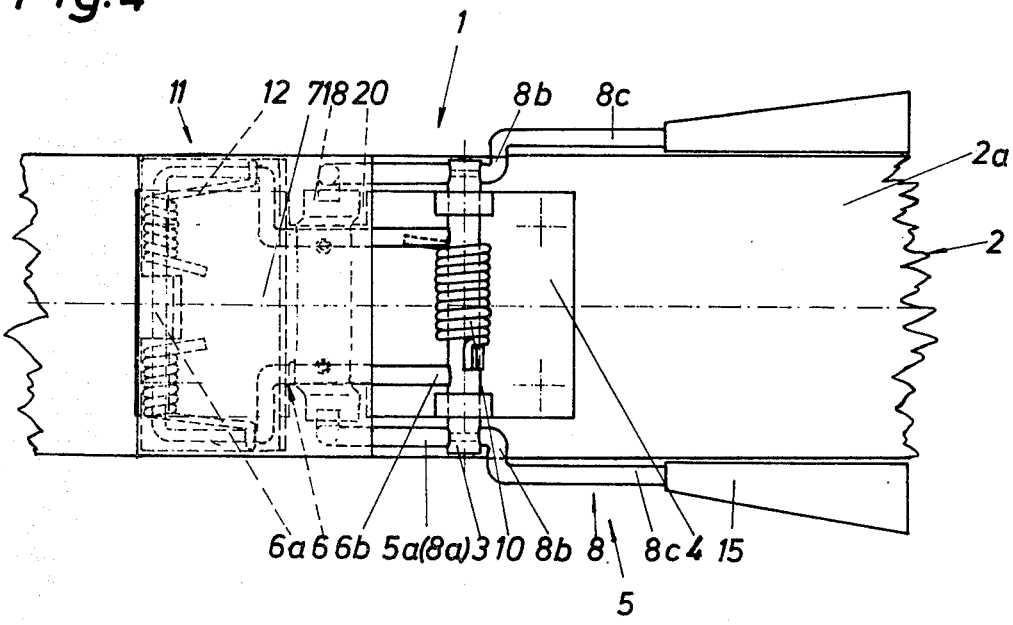

If the ski boot 14 according to FIG. 1 presses down upon the flap 7, for example during a stepping in into a ski binding, to move the hinged connection 6*a* from the braking position thereof in direction of the arrow 22, the braking mandrel 8 will be moved along with the blade 15 in direction of the arrow 23 until the position shown in FIG. 3 is reached. This position will occur particularly when the force of the torsion spring 12, which together with the leaf spring 18 biasses the pedal 11, is stronger than the torsion spring or erecting spring 10 which biasses the axle 3 of the ski brake 1. A comparison of FIGS. 1 and 3 will facilitate a recognition that the position of the braking blade 15 has not changed during this pivotal movement, so that each braking mandrel 8 and each braking blade 15 extends alongside of the associated side edge of the ski 2. By a further stepping down force applied by the sole of the ski boot 14 in direction of the arrow 22' according to FIG. 3, the flap 7 of the pedal 11 presses onto the extension 9 of the braking leg 5 and against the force of the two springs 12 and 18, so that the entire braking leg is pivoted with the associated braking mandrel 8 in direction of the arrow 24 about the swivel shaft 5*a*, until the position shown in FIG. 5 is reached. The arrow 22'' in FIG. 5 indicates the force which the ski boot 14 applies through the pedal 11 onto the entire ski brake 1, wherein the torsion spring 10 of the ski brake 1 and also the torsion spring 12 of the pedal 11 and the leaf spring 18 of the extensions 9 of the braking legs 5 are under tension. Each braking leg 5 and thus also each braking mandrel 8 is now swung at the mentioned angle $\alpha$ such that each braking blade 15 is positioned with its braking surface approximately perpendicular with respect to the upper surface 2*a* of the ski. Further, and due to the angled second segment 8*b* no part of the ski brake 1 projects outwardly beyond the lateral edges of the ski 2 in the retracted position of the ski brake 1, namely in the downhill skiing position.

During a removal of the ski boot 14, be it unintentional due to a fall of the skier or intentional during a stepping out of the ski binding which is not shown, first the flap 7 is pivoted upwardly away from the legs 6*b* of the stepping bar 6 due to the force of the torsion spring 12, after which the extension 9 of the braking mandrel 8 is released and each braking mandrel 8, due to the action of the leaf spring 18, rotates about the axis of the swivel shaft 5*a* of the braking leg 5 in a manner which is opposite to the aforedescribed rotation until the braking position which is shown in FIG. 1 is reached, caused by the erection spring 10. The braking position can also be reached by the braking blade 15 coming into contact with the upper surface of the ski 2*a* and receiving here a twisting motion which is opposite to the earlier mentioned arrow directions 23, 24. In this case, the use of the separate leaf spring 18 is not necessary. Of course, in this case the force of the torsion spring 12 must be greater than the force of the erecting spring 10.

As one will recognize from FIGS. 8 and 9, the normal distances of the first segments 8*b'*, 8*b''* from the lateral edges of the ski can have different dimensions, so that the associated braking mandrels 8' or 8'' can be utilized for narrow or wide skis with the same effect. It is preferable for this case, if the braking mandrels 8', 8'' are releasably fixed to the individual swivel shaft of the braking legs 5. In this case, it is possible to connect a resilient pin 17 to the swivel shaft 5*a*, the locking pin 17*a* of which pin 17 can be moved radially against the force of a small leaf spring 17*b* which is secured on the swivel shaft 5*a*. In the moved-in position of the locking pin 17*a*, it is possible to pull the braking mandrel 8' or 8'', which is to be exchanged, off from the swivel shaft 5*a* in an axial direction and the other, more desired braking mandrel 8'' or 8' can be mounted thereon. In this manner, the use of an otherwise uniform ski brake is made possible for skis having differing widths.

However, one can also proceed, as is shown in FIG. 10, in a manner wherein the length of the axle 3', which pivotally supports the two braking mandrels 8, is constructed in two parts and can be adjusted in axial direction. A telescopelike arrangement is provided, in which one end 3'*a* of the axle is axially movable in a cavity in the other half 3'*b* of the axle and can be locked in the respectively desired position by any convenient means, as by a screw-coupling. One could also speak of a continuous screw threadlike adjustment; however, this statement is only true with the limitation that each adjustment is limited to at least one half rotation (180°). In this case, a releasable locking of the braking mandrels on the individual swivel shafts is absolutely necessary.

If one is satisfied with an adjustment from a full rotation (360°), then it is possible to use also braking mandrels which are arranged fixedly by means of pins on the individual swivel shafts. It is furthermore necessary that at least the stepping bar of the pedal is adjustable with respect to the width of the ski. This can be accomplished for example by dividing the bight 6A of the stepping bar 6 into two parts by using a sleeve which receives both parts of the bight therein. The sleeve may also be a part of the pedal itself or of the flap. The further structure of the ski brake and its operation corresponds with the structure already described above.

However, in order to assure also in deep snow an immediate braking action of the ski brake 1, which braking action is sufficient for stopping the ski 2 which, following a safety release, slides down the hill, it is possible to use a deep snow braking blade 15' (see FIG. 7A). It is arranged on a braking mandrel 8''' and can therefore, as is illustrated in the exemplary embodiment according to FIGS. 8 and 9, be fixed on a swivel shaft 5*a* with the aid of a locking pin 17*a* which is secured to a small leaf spring 17*b*. The exchange of braking blades 15 and deep snow braking blades 15' can therefore also be carried out by laypersons without the use of tools in a simple and quick manner.

The invention is not limited to the described exemplary embodiments. Further modifications are conceivable without departing from the scope of the invention. For example, the described variations can be used interchangeably. It is also possible to design the braking blades differently, for example to construct the free ends of the same with a tooth system in order to achieve in particular, in the case of iced-up slopes, a better grip with respect to the ice/snow. It is also easily possible to use particularly wide braking blades for deep snow, which would then have, for example, the design indicated by dash-dotted lines in FIG. 5. Since the ski width has no influence with respect to the operation of the ski brake, it can be used without difficulties in association with existing ski brakes. Also in this case a releasable connection of the braking mandrels to the swivel shaft of the braking legs is necessary. However, one can also proceed in such a manner that for this case only the braking blades are exchanged; one can use here a similar locking connection, as is shown and described with reference to FIG. 8. It is also not necessary to use a separate pedal with one or with two torsion springs and with a stop; also the use of one single structural part for the leaf spring material is possible. If the structure of the ski brake permits a suitable dimensioning, the use of a stop is not needed in the described embodiment by effecting a connection of the extensions and the leaf springs which are associated with said extensions.

A further modification consists in the two-part constructed axle consisting of two separate coaxial shaft parts, which are supported in a bearing sleeve. The two shaft parts can be adjusted in axial direction in a manner which is described in connection with FIG. 10. However, one can proceed also in such a manner that one shaft part can be locked in the hollow pipe-shaped part in the other shaft part or both shaft parts can be locked in the bearing sleeve through a bayonet lock. Recesses which extend parallel to one another in the axial direction are provided for this purpose, which recesses are connected to one another through an elongated groove which extends in the axial direction, into which groove a locking pin in each stub end of the axle or in the separate shafts can be introduced and is lockable in the desired axial position by introduction of the pin into a further groove which extends along an arc and intersects the axially extending groove. The arcuately extending groove is thereby constructed in such a manner that it extends outside of the swivelling range of the ski brake at least with the axially extending groove. The arrangement is necessary in order to prevent an undesired adjustment of the ski brake in axial direction. It is easily understandable that in the case of an adjustable axle arrangement, the wire sections of the stepping bar, which are provided in the area of the pedal, are also divided to facilitate a deformation-free adjustment of the ski brake to different width skis.

For the purpose of a convenient adjustment to different width skis, the two separate shafts can be biassed by a pressure spring which is arranged between the separate shafts. It is preferable in this case if the groove which extends in axial direction is constructed as one single blind groove, so that in connection with the adjustment only one separate shaft part must be supported so that it will not move out of the bearing sleeve.

The bearing sleeve can be constructed in a conventional manner as part of the mounting member.

An acute angle $\beta$ will be recognized between the pedal 11 and the stepping plate 6 in the braking retracted position of the ski brake 1, in FIG. 5 which angle $\beta$ is approximately 0° due to the stepping down force applied to the pedal 11.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a ski brake having at least one braking leg pivotal by a force applied by a ski boot or by a sole plate secured to a ski boot to a pedal about an axle extending substantially at a right angle with respect to the longitudinal axis of a ski in a mounting member secured to said ski, said braking leg being pivotal between a braking position and a retracted position, an erecting spring resisting a pivoting of said braking leg toward said retracted position, said braking leg having a braking mandrel thereon and a first segment therein which extends from said braking mandrel toward the central longitudinal axis of the ski, said braking leg being held totally above the upper surface of said ski and between the lateral edges of said ski in the retracted position of said ski brake by said pedal which is stepped down upon by said ski boot or by said sole plate, and in the braking position of said ski brake, said braking mandrel is positioned laterally outside of one of said ski edges and said braking leg projects below the running surface of said ski, said braking leg being pivotal about first means defining a swivel shaft which extends in longitudinal direction of the ski, the improvement comprising wherein said first means defining a swivel shaft includes at least one further second segment on said braking leg which extends substantially parallel with respect to said central longitudinal axis of said ski brake, and second means operatively connecting said second segment to said axle to facilitate said pivotal movement of said braking leg about the axis of said second segment.

2. The ski brake according to claim 1, wherein the spacing between said braking mandrel and the plane of the upper surface of the ski increases during a swivelling of said braking leg into said retracted position and is the greatest in said retracted position of said ski brake.

3. The ski brake according to claim 1 or 2, wherein said braking mandrel is held in the retracted position of the ski-brake above a plane which extends through the axis of said swivel shaft and approximately parallel with respect to said upper surface of the ski.

4. The ski brake according to claim 1, wherein said braking leg is constructed of one single wire having at least two bends therein.

5. The ski brake according to claim 4, wherein said braking leg has a third segment integral therewith to which is applied the force for effecting a pivoting of said braking leg about said axis of said swivel shaft.

6. The ski brake according to claim 5, wherein said third segment includes fourth and fifth segments which are operatively connected to said pedal, said extension being arranged at the end of said swivel shaft which is remote from said first segment.

7. The ski brake according to claim 6, wherein said fourth segment of each extension is positioned perpendicularly with respect to said swivel shaft of said braking leg.

8. The ski brake according to claim 6, wherein said fifth segment of each extension extends at an acute angle to the longitudinal axis of the ski brake, and wherein said fifth segment is constructed as a free end of said extension.

9. The ski brake according to claim 5, wherein said ski brake has two braking legs, one on each side of said ski, wherein each braking leg has said braking mandrel thereon and is held pivoted at approximately 90° in the retracted position of said ski brake in relationship to said pedal with respect to its position which it assumes in said braking position and including a further spring, which is independent from said erecting spring of the ski brake, for resisting movement of said braking leg about said swivel axle during movement thereof from said braking position toward said retracted position.

10. The ski brake according to claim 9, wherein said further spring is a leaf spring which is secured to said pedal and has approximately a U-shaped profile with two bent flanges which grip under each of the free ends of said third segments.

11. The ski brake according to claim 9, wherein said second means includes a radially extending opening in opposite ends of said axle, each opening receiving the associated one of said swivel shafts of the individual braking legs therethrough.

12. The ski brake according to claim 1, wherein said pedal includes first and second parts, wherein said first part is a U-shaped stepping bar which is fixedly connected to said axle of said ski brake and said second part is a flap which is hingedly connected to a bight portion of said stepping bar, which bight portion extends substantially at a right angle with respect to the longitudinal axis of said ski.

13. The ski brake according to claim 12, wherein between said stepping bar and said flap there is arranged a spring which resiliently biasses said flap away from said stepping bar about the axis of said bight portion.

14. The ski brake according to claim 13, wherein said spring is arranged on said bight portion of said stepping bar, and wherein said spring includes two torsion springs.

15. The ski brake according to claim 13, wherein said braking leg has a third segment integral therewith to which is applied the force for effecting a pivoting of said braking leg about said axis of said swivel shaft, wherein means are provided for enabling said spring to also bias said braking legs, said means comprising a part of said pedal which grips under said third segment.

16. The ski brake according to claim 15, wherein said mounting member has recesses therein for receiving the free ends of said third segments therein, the depth of said recesses corresponding at least to the height dimension of each of said free ends of said third segments.

17. The ski brake according to claim 1, wherein for each ski brake there are provided two pairs of braking mandrels with different length first segments, and means for releasably mounting each of said pairs of braking mandrels onto said swivel shaft of the individual braking legs of the ski brake.

18. The ski brake according to claim 1, wherein said axle of the ski brake is constructed in two parts and is adjustable in axial direction and includes means for locking said axle to the desired length.

19. The ski brake according to claim 18, wherein one part of said axle of the ski brake has a stub end introduced into a cavity in the other part of said axle.

* * * * *

UNITED STATES PATENT AND TRADEMARK OFFICE

CERTIFICATE OF CORRECTION

PATENT NO. : 4 268 060

DATED : May 19, 1981

INVENTOR(S) : Josef Svoboda

It is certified that error appears in the above—identified patent and that said Letters Patent is hereby corrected as shown below:

Col. 9, line 14; after "third segment" insert ---extension---.

Col. 9, line 18; after "third segment" insert ---extension---.

Signed and Sealed this

First Day of September 1981

[SEAL]

*Attest:*

GERALD J. MOSSINGHOFF

*Attesting Officer*

*Commissioner of Patents and Trademarks*